US011371186B2

(12) United States Patent
Lambert

(10) Patent No.: US 11,371,186 B2
(45) Date of Patent: Jun. 28, 2022

(54) METHOD AND SYSTEM FOR TREATING BIOMASS

(71) Applicant: Valmet AB, Sundsvall (SE)

(72) Inventor: Francois Lambert, Sundsvall (SE)

(73) Assignee: Valmet AB, Sundsvall (SE)

( * ) Notice: Subject to any disclaimer, the term of this patent is extended or adjusted under 35 U.S.C. 154(b) by 132 days.

(21) Appl. No.: 16/348,811

(22) PCT Filed: Dec. 7, 2017

(86) PCT No.: PCT/EP2017/081930
§ 371 (c)(1),
(2) Date: May 9, 2019

(87) PCT Pub. No.: WO2018/104490
PCT Pub. Date: Jun. 14, 2018

(65) Prior Publication Data

US 2019/0271113 A1 Sep. 5, 2019

(30) Foreign Application Priority Data

Dec. 8, 2016 (EP) ..... 16202942

(51) Int. Cl.
*D21C 1/04* (2006.01)
*D21C 11/00* (2006.01)
(Continued)

(52) U.S. Cl.
CPC ..... *D21C 11/0042* (2013.01); *D21B 1/36* (2013.01); *D21C 1/00* (2013.01); *D21C 1/04* (2013.01); *D21C 3/00* (2013.01); *D21C 7/00* (2013.01)

(58) Field of Classification Search
CPC ..... D21C 11/0042; D21C 1/00; D21C 1/04; D21C 3/00; D21C 7/00; D21B 1/36
See application file for complete search history.

(56) References Cited

U.S. PATENT DOCUMENTS 4,187,141 A 2/1980 Ahrel
5,266,159 A 11/1993 Greenwood et al.
(Continued)

FOREIGN PATENT DOCUMENTS

CN 1568246 A 1/2005
CN 101268121 A 9/2008
(Continued)

OTHER PUBLICATIONS

Extended European Search Report in EP Application No. 16202908.6, dated Mar. 13, 2017 (7 pages).
(Continued)

*Primary Examiner* — Jacob T Minskey
(74) *Attorney, Agent, or Firm* — Foley & Lardner LLP

(57) ABSTRACT

The invention relates to a method for treating biomass (2). In a step (S10), biomass (2) and an impregnation liquid are fed into a first reactor unit (10) such that the biomass (2) is impregnated with the impregnation liquid while the biomass (2) is transferred through the first reactor unit (10) by a conveyor means (11). In another step (S20), the impregnated biomass (2*a*) is transferred from the first reactor unit (10) to a separation unit (25), wherein at least a part of the impregnation liquid is separated from the impregnated biomass (2*a*) within the separation unit. In a step (S30), the separated impregnation liquid is discharged from the separation unit (25), such that a first part (26*a*) of the impregnation liquid is recirculated back to the first reactor unit (10). The invention further relates to a system for treating biomass (2).

20 Claims, 2 Drawing Sheets

(51) Int. Cl.

| | |
|---|---|
| ***D21B 1/36*** | (2006.01) |
| ***D21C 7/00*** | (2006.01) |
| ***D21C 3/00*** | (2006.01) |
| ***D21C 1/00*** | (2006.01) |

(56) References Cited

U.S. PATENT DOCUMENTS

| | | | | |
|---|---|---|---|---|
| 2004/0060673 | A1 | 4/2004 | Phillips et al. | |
| 2004/0234692 | A1 | 11/2004 | Nopper | |
| 2009/0065158 | A1* | 3/2009 | Benjelloun Mlayah | D21C 3/20 162/16 |
| 2014/0083918 | A1 | 3/2014 | Nguyen et al. | |
| 2014/0315258 | A1* | 10/2014 | Nguyen | C12P 19/14 435/99 |

FOREIGN PATENT DOCUMENTS

| | | | |
|---|---|---|---|
| CN | 101341288 | A | 1/2009 |
| CN | 101798584 | A | 8/2010 |
| CN | 101802299 | A | 8/2010 |
| CN | 101835804 | A | 9/2010 |
| CN | 101952449 | A | 1/2011 |
| CN | 101953226 | A | 1/2011 |
| CN | 102177293 | A | 9/2011 |
| CN | 103097606 | A | 5/2013 |
| CN | 103339237 | A | 10/2013 |
| CN | 103898780 | A | 7/2014 |
| WO | WO-99/41448 | A1 | 8/1999 |
| WO | WO-2004/005608 | A1 | 1/2004 |
| WO | WO-2007/009463 | A2 | 1/2007 |
| WO | WO-2007/063171 | A1 | 6/2007 |
| WO | WO-2009/012779 | A2 | 1/2009 |
| WO | WO-2009/012779 | A3 | 5/2009 |
| WO | WO-2011/039635 | A2 | 4/2011 |
| WO | WO-2015/014364 | A1 | 2/2015 |
| WO | WO-2015/026583 | A1 | 2/2015 |
| WO | WO-2015/199604 | A1 | 12/2015 |
| WO | WO-2016/199604 | A1 | 12/2016 |

OTHER PUBLICATIONS

International Search Report & Written Opinion in International Application No. PCT/EP2017/081929, dated Feb. 1, 2018 (11 pages).

International Search Report and Written Opinion in International Application No. PCT/EP2017/081916, dated Jan. 18, 2018 (11 pages).

International Search Report and Written Opinion in International Application No. PCT/EP2017/081930, dated Feb. 6, 2018 (12 pages).

Foreign Office Action on CN Patent Application No. 201780069706.5 dated Feb. 26, 2021 (including English translation) (13 pages).

Foreign Office Action on CN Patent Application No. 201780069714.X dated Mar. 3, 2021 (with English translation) (23 pages).

Foreign Office Action on CN Patent Application No. 201780069753.X dated Mar. 5, 2021 (with English translation) (20 pages).

Hongzhang Chen, Lignocellulose Biorefinery Engineering, Principles and Applications, Woodhead Publishing Series in Energy: No. 74, 2021, 275 pages.

* cited by examiner

METHOD AND SYSTEM FOR TREATING BIOMASS

CROSS-REFERENCE TO RELATED APPLICATIONS

The present application is a U.S. National Phase Entry Application under 35 U.S.C. § 371 that claims the benefit of International Application No. PCT/EP2017/081930, filed on Dec. 7, 2017, and which in turn claims the benefit of EP Application No. 16202942.5, filed on Dec. 8, 2016, the entire disclosures of which are incorporated herein by reference.

FIELD OF THE INVENTION

The invention generally relates to impregnation systems. In particular, the invention relates to a method for treating biomass as well as to a system for treating biomass.

BACKGROUND OF THE INVENTION

Treating biomass becomes relevant in many different fields. For example, an impregnation of biomass is a treatment process in the paper and pulp industry in which the biomass is impregnated with an impregnation liquid such that a reaction between the biomass and the impregnation liquid takes place. After the reaction between the biomass and the impregnation liquid, excess or residual impregnation liquid which was not used during the impregnation may be discharged such that a transfer of residual impregnation liquid to subsequent steps after the impregnation step is prevented. It is further required to provide a homogeneous impregnation during the impregnation step. Therefore, it is important to adjust the amount of impregnation liquid required for a certain amount of biomass.

SUMMARY OF THE INVENTION

It is an object of the present invention to provide an improved impregnation process for biomass.

This object is achieved by the subject-matter of the independent claims. Further exemplary embodiments are evident from the dependent claims and the following description.

According to an aspect of the present invention, a method for treating biomass is given. In a step of the method, the biomass and an impregnation liquid are fed into a first reactor unit such that the biomass is impregnated with the impregnation liquid while the biomass is transferred through the first reactor unit by a conveyor means. In another step, the impregnated biomass is transferred from the first reactor unit to a separation unit wherein at least a part of the impregnated liquid is separated from the impregnated biomass within the separation unit. In another step, the separated impregnation liquid is discharged from the separation unit such that only a first part of the separated impregnation liquid is recirculated back to the first reactor unit.

Using such a method for treating biomass advantageously provides a better utilization of the impregnation liquid since impregnation liquid which was already used for the impregnation of the biomass can be recirculated back to the first reactor in which the impregnation of the biomass takes place. In other words, the impregnation liquid can be reused or recycled. This leads to a better utilization of the filtrate and better impregnation of raw material, e. g. biomass, with the impregnation liquid resulting in a more homogeneous impregnation or hydrolysis of the biomass.

The conveyor means with which the biomass is transferred through the first reactor may be a screw conveyor. For example, the first reactor unit is a longitudinal vessel arranged vertically with respect to an earth's surface. In this manner, it is possible to fill the first reactor unit with impregnation liquid up to a predetermined fill level such that the entire biomass is transferred through the impregnation liquid. This means that the biomass is transferred in an upward direction within the first reactor unit and through the impregnation liquid such that a homogeneous impregnation of the biomass with the impregnation liquid is achieved. After the biomass has been impregnated with the impregnation liquid it is conveyed or transferred to the separation unit such that excess impregnation liquid which was not used during the impregnation of the biomass can be discharged at the separation unit and recirculated back to the first reactor unit. Between the impregnation within the first reactor unit and the separation of the impregnation liquid within the separation unit, further steps such as for example a hydrolysis in a second reactor unit may be provided. In particular, a hydrolysis of the biomass may be carried out in the second reactor unit in the presence of impregnation liquid. The material may then be diluted at a downstream part of the second reactor unit, e.g. between the second reactor unit and the separation unit. The dilution may be carried out with impregnation liquid or a part of the impregnation liquid which is not recirculated back to the first reactor unit but also with a part of the impregnation liquid which is recirculated back to the first reactor unit.

However, the separated impregnation liquid is divided into different parts such that only one part, e. g. the first part of the impregnation liquid is recirculated back to the first reactor unit. This means that the first part of the impregnation liquid may be recirculated back to the first reactor unit whereas a second part of the impregnation liquid which was separated from the impregnated biomass in the separation unit is transferred to another step of the process, for example to a treatment step downstream of the separation unit. This aspect will be explained in more detail hereinafter.

The separation unit may comprise a plurality of different separation devices such that a stepwise separation of the impregnation liquid from the impregnated biomass is provided. Preferably, the separation of the impregnation liquid from the impregnated biomass is carried out in two different steps. The separation unit may comprise a screw conveyor by means of which the impregnated biomass is transferred through the separation unit during the separation of the impregnation liquid from the impregnated biomass.

Further conveyor means, like for instance screw conveyors, may be integrated into the system in order to enable the conveyance or transfer of the impregnated biomass from the first reactor unit to the separation unit.

According to an embodiment of the invention, the separation of the impregnation liquid within the separation unit comprises a compression stage in which the impregnation liquid is released from the impregnated biomass by compressing the impregnated biomass preferably with a screw press.

In this manner, it is possible to effectively extract the impregnation liquid from the impregnated biomass, in particular the impregnation liquid which was not used during the foregoing steps like the impregnation itself or a hydrolysis step. The unused impregnation liquid may be defined as the part of the impregnation liquid which did not react with the biomass in the impregnation step or hydrolysis step. The extracted impregnation liquid may contain organic acid such as acetic acid created during the hydrolysis of the raw material, e.g. the biomass. The concentration of organic acid may vary depending on the fraction of the extracted liquid. The impregnation liquid may also contain sugar as monomer or oligomer as well as solid material such fiber.

The screw press which may have the shape of a plug screw provides the required pressure within the material such that the impregnation liquid can be released from the pores or cavities within the material, e. g. within the impregnated biomass. It is possible to set a predetermined pressure within the separation unit such that a compression of impregnated biomass is enabled in order to release the impregnation liquid from the impregnated biomass. However, the present invention is not limited to a screw press in order to provide the required pressure for releasing the impregnation liquid from the impregnated biomass.

According to another embodiment of the invention, the first part of the impregnation liquid released from the impregnated biomass in the compression stage is recirculated back to the first reactor unit whereas another part, e. g. the second part of the impregnation liquid released from the impregnated biomass in the compression stage is transferred to a treatment step downstream the separation unit.

The part of the impregnation liquid released from the impregnated biomass in the compression stage which is recirculated back to the first reactor unit may also be referred to as the first part of the impregnation liquid released from the impregnated biomass. In particular, the part of the impregnation liquid that contains much acid, e.g. more than a predetermined content of acid, and/or less sugar, e.g. less than a predetermined content of sugar, is recirculated back to the first reactor unit.

The other part of the impregnation liquid released from the impregnated biomass in the compression stage which is transferred to the treatment step downstream the separation unit may also be referred to as the second part of the impregnation liquid released from the impregnated biomass.

It is also possible that the other part, e. g. the second part of impregnation liquid released from the impregnated biomass is not transferred to a treatment step downstream the separation unit, but is instead used for other purposes or simply disposed. Recirculating the first part of impregnation liquid back to the first reactor unit may be carried out simultaneously or alternatively to transferring the second part of the impregnation liquid to the treatment step downstream the separation unit. The ratio between the first part of impregnation liquid and the second part of impregnation liquid may be between 0.5 and 5 if gravity draining is used in a first stage, e.g. a drainage stage, and compression is used in a second stage, e.g. a compression stage. The different stages will be described in the description of the figures in more detail. The ratio between the first part of impregnation liquid and the second part of impregnation liquid may be between 0.5 and 3 if the biomass is diluted at the downstream part of the second reactor unit. If no dilution occurs downstream of the second reactor unit, the ratio between the first part of impregnation liquid and the second part of impregnation liquid may be between 1.5 and 3.

It is possible that the ratio between the first part of impregnation liquid and the second part of impregnation liquid may be up to about 20 to 25 if a compression screw is used for the separation. Additionally, the separated impregnation liquid, e.g. the filtrate, may be collected in a different zone apart from the compression screw, in particular when no separate draining stage or draining screw is provided.

However, the separation unit may comprise two stages in which the impregnation liquid is released from the impregnated biomass. For example, in the first stage, the first part of impregnation liquid is released from the impregnated biomass and in the second stage, the second part of impregnation liquid is released from the impregnated biomass. The stage or location at which the impregnation liquid is released from the impregnated biomass may determine the target location to which the different parts of impregnation liquid are supplied.

According to another embodiment of the invention, the separation of the impregnation liquid within the separation unit comprises a drainage stage in which free impregnation liquid is drained from the impregnated biomass preferably by gravity draining.

In this case, the free impregnation liquid may be drained from the impregnated biomass without compression. It should be understood that free impregnation liquid in the sense of the present invention means that this kind of liquid may be released from the impregnated biomass without compression or other activities on the impregnated biomass. In other words, free impregnation liquid may be obtained by gravity effects since this type of impregnation liquid is not chemically bound within the biomass. In particular, the free impregnation liquid is released from the impregnated biomass by the influence of the earth's gravity such that the impregnation liquid simply flows out or is drained off the impregnated biomass. Therefore, the free impregnation liquid may also be referred to as gravity drained impregnation liquid. Afterwards, the drained free impregnation liquid may be received within a drain tray.

The free impregnation liquid which is drained from the impregnated biomass is to be distinguished from the part of the impregnation liquid which is released from the impregnated biomass in the compression stage. In other words, there exist two stages in the separation unit wherein in a first stage, a drainage of free impregnation liquid is provided and in a second stage, a compression of the impregnated biomass is provided such that the impregnation liquid is squeezed out of the impregnated biomass.

According to another embodiment of the invention, the free, e. g. gravity drained impregnation liquid drained from the impregnated biomass in the drainage stage is transferred to a treatment step downstream the separation unit.

Therefore, it is possible that the second part of the impregnation liquid is the free impregnation liquid that is released from the impregnated biomass and transferred to the treatment step downstream the separation unit. Furthermore, it is possible that the first part of the impregnation liquid is the part of the impregnation liquid that is released from the impregnated biomass in the compression stage and which is recirculated back to the first reactor unit. This aspect will be described in more detail in the description of the figures.

According to another embodiment of the invention, a fractionation of the separated first part of impregnation liquid is carried out in a fractionation unit until a predetermined purity degree of the recirculated impregnation liquid is reached.

According to yet another embodiment of the invention, a fractionation of the separated second part of impregnation liquid is carried out in the fractionation unit, for example simultaneously to the fractionation of the first part of the separated impregnation liquid, until a predetermined purity degree of the second part of the separated impregnation liquid is reached.

According to another embodiment of the invention, a filtration of the separated first part of impregnation liquid is carried out in a filtration unit until a predetermined purity degree of the recirculated impregnation liquid is reached.

According to yet another embodiment of the invention, a filtration of the separated second part of impregnation liquid is carried out in the filtration unit, for example simultaneously to the filtration of the first part of the separated impregnation liquid, until a predetermined purity degree of the second part of the separated impregnation liquid is reached.

For example, the filtration may be carried out to separate a solid phase present in the liquid, e.g. fibers, from a dissolved substance. Therefore, a screening equipment for observing the predetermined purity degree of the impregnation liquid and a filter or other separation equipment may be provided for achieving the preferred purity degree of impregnation liquid after separation. The filtered impregnation liquid may be called filtrate or filtered impregnation liquid. However, using the expression recirculated first or second part of impregnation liquid does not exclude that this recirculated impregnation liquid is filtered after separation.

In some cases, only a combined liquid stream, e. g. a stream of impregnation liquid comprising solid fractions is separated from the impregnated biomass. The liquid stream, e. g. the impregnation liquid separated from the impregnated biomass, can then either be sent directly to the first reactor unit or it can first be filtrated. For example, a separation of sugar from furfural is possible in the filtration unit. A membrane filtration and/or a nano-filtration may be applied in order to filter the separated impregnation liquid after it has been separated from the impregnated biomass in the separation unit. For example, solids and particles can be filtered out of the separated impregnation liquid in this way. It can be important to remove solid material such as fiber from the filtrate as to provide a proper recirculation without a clogging of the liquid lines between the separation unit and the first reactor unit. For example, filtration is applied before membrane nano-filtration such that coarse solid fractions can be filtered out of the separated impregnation liquid. During the nano-filtration, certain molecules can be separated from the impregnation liquid. Furthermore, it is advantageous to remove the furfural from the filtrate in order to avoid an undesired enrichment of furfural at certain locations. The filtration may for instance be carried out using a so-called optifilter.

The separation may also be considered as a dewatering or washing of the impregnated biomass. Consequently, the separation stage in which the impregnation liquid is separated from the impregnated biomass may also be called dewatering stage or washing stage.

The separation may be carried out under pressurized conditions. In this case it may also be possible that the impregnation of the biomass in the first reactor unit is also carried out under pressurized conditions. However, it may also be possible that a pressure within the first reactor unit may be adjusted independently of a pressurization of the separation unit. According to the present invention, it is possible to obtain several liquid streams, e. g. impregnation liquid streams which are fed to different steps within the treatment system of the biomass. Each of the liquid streams may be treated differently, for example by applying different filtration methods. The filtration is generally carried out in order to remove solids and dissolved material but also to separate dissolved substances in several fraction.

According to another aspect of the invention, the recirculated first part of impregnation liquid from the separation unit is mixed with impregnation liquid from a reservoir before injecting the mixed impregnation liquid to the first reactor unit.

In particular, the mixing of the recirculated first part of impregnation liquid and the impregnation liquid from the reservoir may be carried out in a pipe between the reservoir and the first reactor unit.

In this manner, it is possible to combine the recirculated impregnation liquid with fresh impregnation liquid from the reservoir. This also provides the possibility to adjust certain chemical characteristics of the impregnation liquid fed into the first reactor unit. For example, the amount of the impregnation liquid fed from the reservoir and/or the amount of impregnation liquid recirculated from the separation unit may be adjusted. However, it is possible to apply a separation of higher gravity particles by sedimentation in a separate tank before or after mixing the recirculated first part of impregnation liquid and the impregnation liquid from the reservoir. The recirculated first part of impregnation liquid may also be fed into the reservoir first in order to mix the fresh impregnation liquid with the recirculated impregnation liquid in the reservoir. In this case the reservoir may be used for the sedimentation of the higher gravity particles in the impregnation liquid. Using a separate tank or the reservoir provides the possibility to control the composition of the impregnation liquid in the system and therefore also the composition of the impregnation liquid to be fed into the first reactor unit.

It is also possible that only water is added or fed into the reservoir and that the impregnation liquid is recirculated in order to recirculate organic acid such as acetic acid that may be formed in a hydrolysis reaction in the second reactor unit.

According to another embodiment of the invention, the recirculated first part of impregnation liquid from the separation unit is injected into the first reactor unit such that the recirculated first part of impregnation liquid is reused for impregnating the fed biomass with the first reactor unit.

Reusing the impregnation liquid which was separated in the separation unit advantageously reduces the costs since the amount of fresh impregnation liquid provided, for example, by the reservoir can be reduced. Furthermore, organic acid which is generated during the hydrolysis in the second reactor unit may be used as chemicals, in particular as chemicals for the impregnation liquid. In other words, the separated impregnation liquid which is recirculated back to the first reactor unit is used for the impregnation of the biomass for a second time. The amount of recirculated impregnation liquid and/or the amount of fresh impregnation liquid from the reservoir may be adjusted such that a predetermined fill level within the reactor unit can be adjusted. The chemical characteristics of the impregnation liquid fed into the first reactor unit can be adjusted by controlling the amount of fresh impregnation liquid and the amount of recirculated impregnation liquid.

According to another embodiment of the invention, the impregnated biomass is fed from the first reactor unit into a second reactor unit before transferring the impregnated biomass to the separation unit wherein a hydrolysis of the impregnated biomass takes place within the second reactor unit.

In other words, the impregnation and the hydrolysis may take place in separate reactor units with different environmental conditions. The transfer of the impregnated biomass from the first reactor unit to the hydrolysis stage, e. g. the second reactor unit, may be provided by a conveyor means, for example by a screw conveyor. However, the second reactor unit in which the hydrolysis takes place may be arranged between the first reactor unit in which the biomass is impregnated and the separation unit in which a part of the impregnation liquid is separated from the impregnated biomass in order to be recirculated back to the first reactor unit.

During the impregnation and hydrolysis of the impregnated biomass, a reaction between the biomass and the impregnation liquid may take place. Therein, most part of the impregnation liquid does not react with the biomass during impregnation or hydrolysis and may therefore be separated from the impregnated biomass in the separation unit.

According to another embodiment of the invention, a transfer of the impregnated biomass from the separation unit to a third reactor unit is carried out wherein a steam impact, in particular a steam explosion on the impregnated biomass takes place within the third reactor unit.

A steam explosion is a violent boiling or flashing of water into a steam due to a rapid pressure drop. In particular, a steam explosion leads to a rapid decrease in pressure resulting in a flashing and a destruction of the structure of the material, e.g. the hydrolyzed or impregnated biomass.

According to an embodiment of the invention, the impregnation liquid comprises chemicals selected from the group consisting of an acid, a catalyst or mixtures thereof. The impregnation liquid may also be pure water.

The chemicals may be added to the impregnation liquid before it is fed into the first reactor unit. Therefore, the chemicals may be fresh chemicals added into the system or reused chemicals from the recirculated impregnation liquid.

For example, the impregnation liquid is an aqueous solution, EtOH or mixtures thereof. The chemicals are selected from the group consisting of a catalyst, an acid, a mineral acid preferably $H_2SO_4$, organic acid preferably acetic acid or mixtures thereof. $H_2SO_4$ is the preferred chemical. Liquid containing acetic acid, for example from the recirculated stream, is also a preferred chemical.

In the context of the present invention, the term "impregnation liquid" is to be understood as a liquid reactant comprising chemicals, wherein the liquid reactant may be an aqueous solution, EtOH or a similar mixture and the chemicals may comprise a catalyst, an acid like $H_2SO_4$ or acetic acid or similar mixtures. The liquid reactant may comprise water or another solvent. Alternatively, a mixture of water and solvent is possible. The liquid reactant may be derived from a recirculation of filtrates, liquids or pressates which are obtained at different positions in the process, especially in the separation unit. However, the liquid reactant may also be a condensate or partial condensate of a steam explosion flash vapor, a byproduct from evaporation, a distillation of fermented slurry, or a filtrate from a further dewatering stage.

According to another embodiment of the invention, the impregnation liquid is fed into the first reactor unit up to a predetermined fill level such that at least a part of the biomass which is fed into the first reactor unit is in permanent contact with the impregnation liquid for a predetermined time span.

Preferably, the entire biomass is in contact with the impregnation liquid for the predetermined time span. In this manner, it is possible that the whole biomass is transferred or conveyed through the impregnation liquid such that a homogeneous impregnation of the biomass with the impregnation liquid takes place. For example, the first reactor unit is vertically arranged with respect to the earth's surface wherein the impregnation liquid is filled into the first reactor unit up to the predetermined fill level. The biomass is fed into the first reactor unit at a bottom part of the first reactor unit and the impregnated biomass is discharged from the first reactor unit at a top part of the first reactor unit. Therefore, the biomass is conveyed in an upward direction within the first reactor unit such that the biomass passes or is conveyed through the impregnation liquid before the impregnated biomass can be discharged from the first reactor unit at the top part.

According to another embodiment of the invention, the conveyor means of the first reactor unit is a screw conveyor arranged with a vertical component, in particular vertically within the first reactor unit such that the biomass is conveyed in an upward direction during the impregnation.

The conveyor means may comprise at least two screw conveyors. In a preferred embodiment of the invention, exclusively two screw conveyors are vertically arranged within the first reactor unit. It is possible that the two screw conveyors are arranged in parallel within the first reactor unit.

The screw conveyor provides a continuous movement of the biomass in the upward direction during the impregnation and ensures that a minimum contact time between the biomass and the impregnation liquid can be provided. The time during which the biomass has to be impregnated by the impregnation liquid is determined by the type of material, e.g. the biomass, or the type of impregnation liquid used for impregnation or by the fill level of the impregnation liquid within the first reactor unit.

However, an adjustment of these influencing parameters may either be carried out manually or automatically within the system.

According to another embodiment of the invention, the biomass is compressed in a compression unit before feeding the biomass into the first reactor unit wherein the compression unit in particular comprises a plug screw for compressing the biomass.

By means of the plug screw, a plug of biomass can be provided before it is fed into the first reactor unit. Thus, the biomass can be fed into the first reactor unit in a compacted form.

In yet another embodiment of the invention, the biomass is pre-compressed in a pre-compression unit before compressing the biomass within the compression unit wherein the pre-compression unit in particular comprises a force feed screw for pre-compressing the biomass.

In this manner, it is possible to compress bulky material like for example straw grass, etc. However, it can be distinguished between wood material or non-wood material which is fed into the first reactor unit as biomass. A pre-compression is preferably used if non-wood material is used as biomass.

According to another embodiment of the invention, the biomass is compressed in a second compression unit before feeding the biomass into the second reactor unit wherein the second compression unit in particular comprises a plug screw for compressing the impregnated biomass. Therein the second compression unit may be arranged between the first reactor unit and the second reactor unit.

In yet another embodiment of the invention, the biomass is pre-compressed in a second pre-compression unit before compressing the biomass within the second compression unit wherein the second pre-compression unit in particular comprises a force feed screw for pre-compressing the impregnated biomass. Therein the second pre-compression unit may be arranged between the first reactor unit and the second reactor unit, in particular between the first reactor unit and the second compression unit.

According to another embodiment of the invention, the biomass is compressed in a third compression unit before feeding the biomass into the third reactor unit wherein the third compression unit in particular comprises a plug screw for compressing the impregnated biomass. Therein the third compression unit may be arranged between the second reactor unit and the third reactor unit.

In yet another embodiment of the invention, the biomass is pre-compressed in a third pre-compression unit before compressing the biomass within the third compression unit wherein the third pre-compression unit in particular comprises a force feed screw for pre-compressing the impregnated biomass. Therein the third pre-compression unit may be arranged between the second reactor unit and the third reactor unit, in particular between the second reactor unit and the third compression unit.

Therefore, at least one compression unit and/or pre-compression unit is arranged upstream of each reactor unit.

According to another embodiment of the invention, at least a part of the recirculated first part of impregnation liquid is recirculated back to a downstream part of the second reactor unit such that a dilution of the impregnated biomass from the second reactor unit takes place. This recirculated first part of impregnation liquid may be fed into a conveyor line between the second reactor unit and the separation unit, wherein the impregnated biomass is transferred through the conveyor line.

According to another embodiment of the invention, at least a part of the recirculated second part of impregnation liquid is recirculated back to a downstream part of the second reactor unit such that a dilution of the impregnated biomass from the second reactor unit takes place. This recirculated second part of impregnation liquid may be fed into a conveyor line between the second reactor unit and the separation unit, wherein the impregnated biomass is transferred through the conveyor line.

According to another aspect of the present invention, a system for treating biomass is given. The system comprises a first reactor unit for impregnating biomass with an impregnation liquid while the biomass is transferred through the first reactor unit by a conveyor means. The system for treating biomass further comprises a separation unit for separating at least a part of the impregnation liquid from the impregnated biomass. The separated impregnation liquid is discharged from the separation unit such that only a first part of the separated impregnation liquid is recirculated back to the first reactor unit.

The discharge of the separated impregnation liquid from the separation unit may be carried out by means of a screw which compresses the impregnated biomass such that the impregnation liquid is released from the impregnated biomass. A pump may be integrated in a line for conveying the separated impregnation liquid between the separation unit and the first reactor unit.

The inventive method and the inventive system for treating biomass may be used in a process for recovering sugars from biomass. The method and the system comprise the impregnation, the hydrolysis and the separation, e. g. a dewatering or washing of the impregnated biomass in the separation unit such that the impregnation liquid is recycled to the impregnation step arranged upstream the hydrolysis step. The impregnation liquid may for instance be an acidic liquid. Residual acidic liquid can be recovered in the process and at the same time a more rapid and/or a more selective hydrolysis can be achieved since the acidic liquid functions as a catalyst in the hydrolysis process.

In general, the method or the process comprises the following steps:

In a first step, an impregnation of the biomass is carried out using the recycled liquid containing acid from the dewatering step, e. g. the separation step. In a second step, the hydrolysis of the material, e. g. the biomass, is carried out. In a third step, the hydrolyzed material is dewatered to remove the liquids in the separation unit. In a fourth step, the removed liquids, e. g. the impregnation liquid is recycled by recirculating the liquid back to the impregnation step in which the biomass is impregnated using the recycled liquid.

DETAILED DESCRIPTION OF THE DRAWINGS

Figure 1:
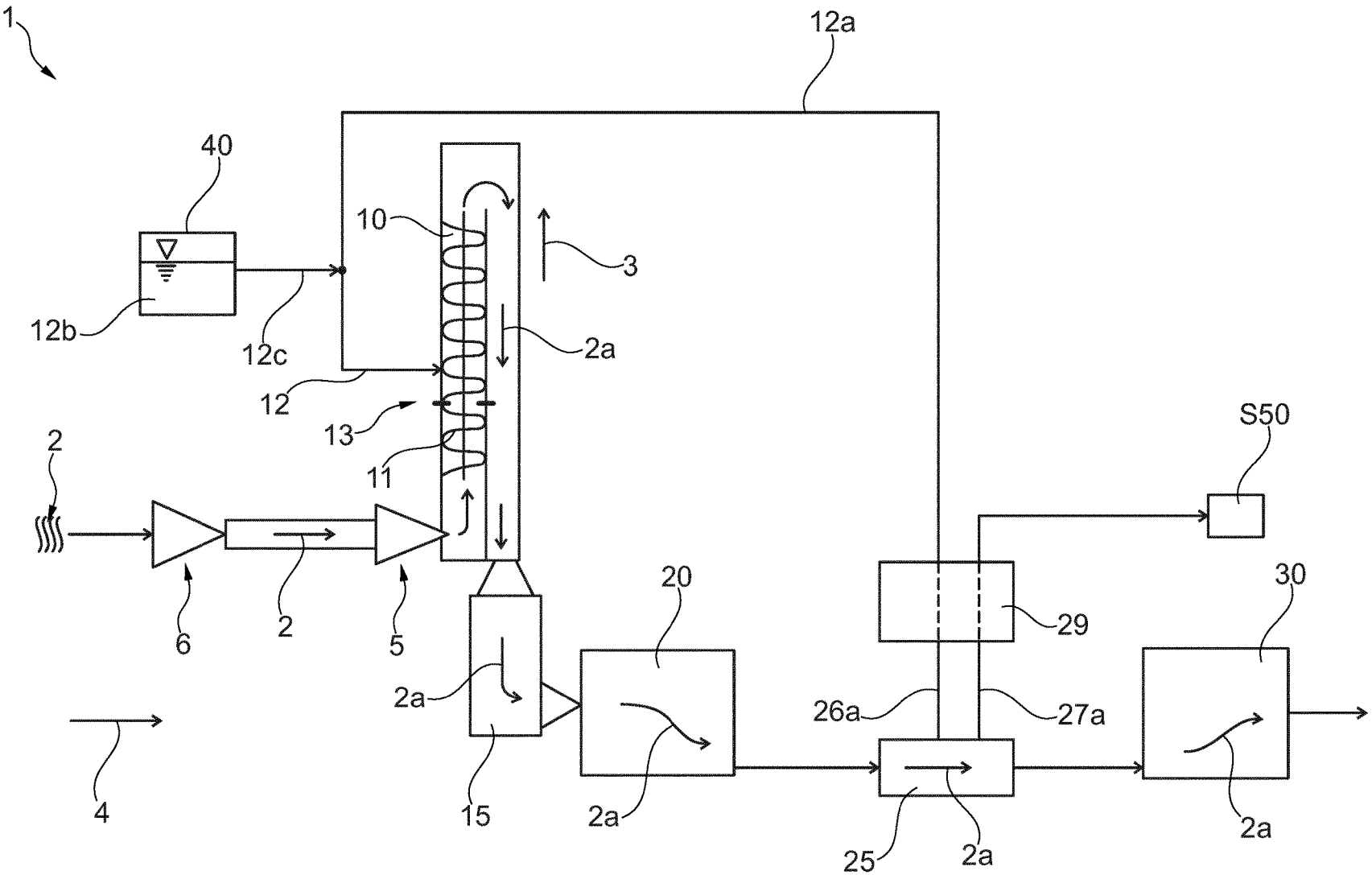
FIG. 1 schematically shows a system for treating biomass according to an embodiment of the invention.

FIG. 1 shows a system 1 for treating biomass 2. The system 1 comprises a first reactor unit 10 for impregnating biomass 2 with an impregnation liquid while the biomass 2 is transferred through the first reactor unit 10 by a conveyor means 11 which for instance is a screw conveyor. The biomass 2 is impregnated with impregnation liquid in the first reactor unit 10 such that impregnated biomass 2*a* is obtained. The separation unit 25 is adapted for separating at least a part of the impregnation liquid from the impregnated biomass 2*a*. The separated impregnation liquid 26*a*, 27*a* is discharged from the separation unit 25 such that only a part of the impregnation liquid 26*a* is recirculated back to the first reactor unit 10.

The biomass 2 is fed by means of a compression unit 5 into the first reactor unit 10. A pre-compression unit 6 may be arranged before the compression unit 5 such that the biomass 2 is pre-compressed in the pre-compression unit 6 before it is further compressed in the compression unit 5. After compressing the biomass 2, it is introduced into the first reactor unit 10. The reactor unit 10 is filled with impregnation liquid up to a predetermined fill level 13. The reactor unit 10 may be a longitudinal vessel vertically arranged with respect to the earth's surface. The vertical direction is indicated by arrow 3 and the horizontal direction which is substantially parallel to the earth's surface is indicated by arrow 4. The biomass 2 is introduced into the reactor unit 10 and is conveyed by the conveyor means 11 in the vertical direction 3 wherein during the conveyance of the biomass 2 through the first reactor unit 10, the biomass 2 is impregnated by the impregnation liquid filled into the first reactor unit 10. The impregnation liquid may be provided by a reservoir 40 and/or by a recirculation circuit which is connected to the separation unit 25.

The impregnated biomass 2*a* is then fed into a buffer tank 15 which is arranged between the first reactor unit 10 and a second reactor unit 20 in which a hydrolysis of the impregnated biomass 2*a* takes place.

The impregnated biomass 2*a* is then transferred to the separation unit 25 after the hydrolysis of the impregnated biomass 2*a* within the second reactor unit 20. In the separation unit 25, the impregnated biomass 2*a* and the impregnation liquid solved in the impregnated biomass 2*a* are at least partly separated. In particular, the impregnation liquid is separated from the impregnated biomass 2*a* within the separation unit 25. The impregnation liquid separated from the impregnated biomass 2*a* is then discharged wherein only a part of the impregnation liquid 26*a* is recirculated back to the first reactor unit 10, for example via recirculation line 12*a*. Another part 27*a* of the separated impregnation liquid may be discharged and fed to a further treatment step S50 downstream the separation unit 25. Before the first part of the separated impregnation liquid 26*a* is fed back into the reactor unit 10, a filtration of this impregnation liquid 26*a* may be carried out in a filtration unit 29. For example, before the first part of the separated impregnation liquid 26*a* is fed back into the reactor unit 10, a fractionation of this impregnation liquid 26*a* may be carried out in a fractionation unit 29. The second part of the impregnation liquid 27*a* which is fed to a further treatment step S50 downstream the separation unit 25 may also be filtered in the fractionation unit 29. Within the fractionation unit or filtration unit 29, a separation of solid particles within the impregnation liquid may be carried out such that a predetermined purity degree of the recirculated impregnation liquid 26*a* as well as for the second part of the impregnation liquid 27*a* which is fed to the treatment step S50 may be adjusted. Evaporation and concentration of compounds present in the separated impregnation liquid 26*a* may also be carried out in the fractionation unit 29.

The impregnated biomass 2*a* is transferred to a third reactor unit 30 after the separation of the excess impregnation liquid within the separation unit 25. In the third reactor unit 30, a steam explosion reaction of the impregnated biomass 2*a* is carried out.

Before feeding the impregnation liquid into the first reactor unit 10 via the recirculation line 12*a*, a mixing of fresh impregnation liquid 12*b* from the reservoir 40 and the recirculated impregnation liquid 26*a* from the separation unit 25 may be carried out. In this manner, it is possible to adjust chemical characteristics of the impregnation liquid fed into the first reactor unit 10. Therefore, the line 12*a* for feeding the recirculated impregnation liquid 26*a* from the separation unit 25 as well as a line 12*c* from the reservoir 40 are connected in order to feed the mixed impregnation liquid via line 12 into the first reactor unit 10.

Figure 2A:
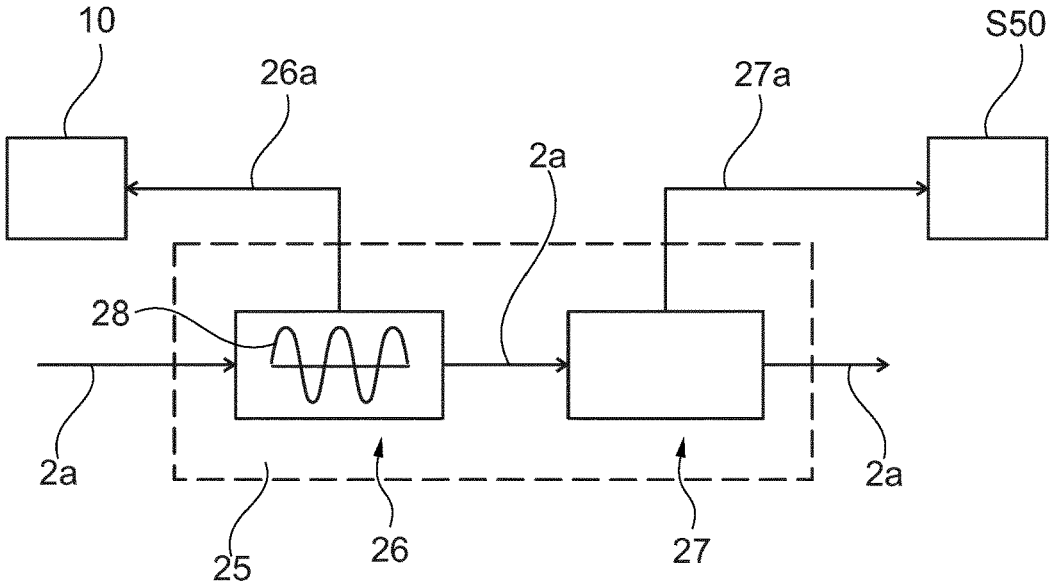
FIG. 2A shows a separation unit according to an embodiment of the invention.

FIG. 2A shows an embodiment of the separation unit 25 in detail. In particular, FIG. 2A shows a two-staged separation unit 25 in which a drainage stage 27 and a compression stage 26 are provided. The impregnated biomass 2*a* is fed into the drainage stage 27 in which free impregnation liquid 27*a* is drained from the impregnated biomass 2*a*. This free impregnation liquid 27*a* which may also be called the second part of the impregnation liquid 27*a* is then transferred to a treatment step S50 downstream the separation unit 25. However, it is also possible that this drained, second part of the impregnation liquid 27*a* is recirculated back to the first reactor unit 10.

The impregnated biomass 2*a* is then fed into the compression stage 26 in which the first part of the impregnation liquid 26*a* is released from the impregnated biomass 2*a* by compression. The compression may be provided by a screw press 28 in the compression stage 26. The first part of the impregnation liquid 26*a* released from the impregnated biomass 2*a* in the compression stage 26 is also recirculated back to the first reactor unit 10. The separation unit 25 may comprise other stages in which impregnation liquid can be released from the impregnated biomass 2*a*. The characteristics, e. g. the composition of the impregnation liquid separated in the drainage stage 27 and in the compression stage 26 of the separation unit 25 may be different. In particular, the characteristics of the separated impregnation liquid 26*a*, 27*a* may determine the target location of the separated parts of impregnation liquid 26*a*, 27*a*, for example whether these parts of impregnation liquid 26*a*, 27*a* are transferred to the first reactor unit 10 or to the treatment step S50 downstream the separation unit 25.

As shown in FIG. 2A the compression stage 26 is arranged before the drainage stage 27 within the separation unit 25. However, it is also possible that the drainage stage 27 is arranged before the compression stage 26.

Figure 2B:
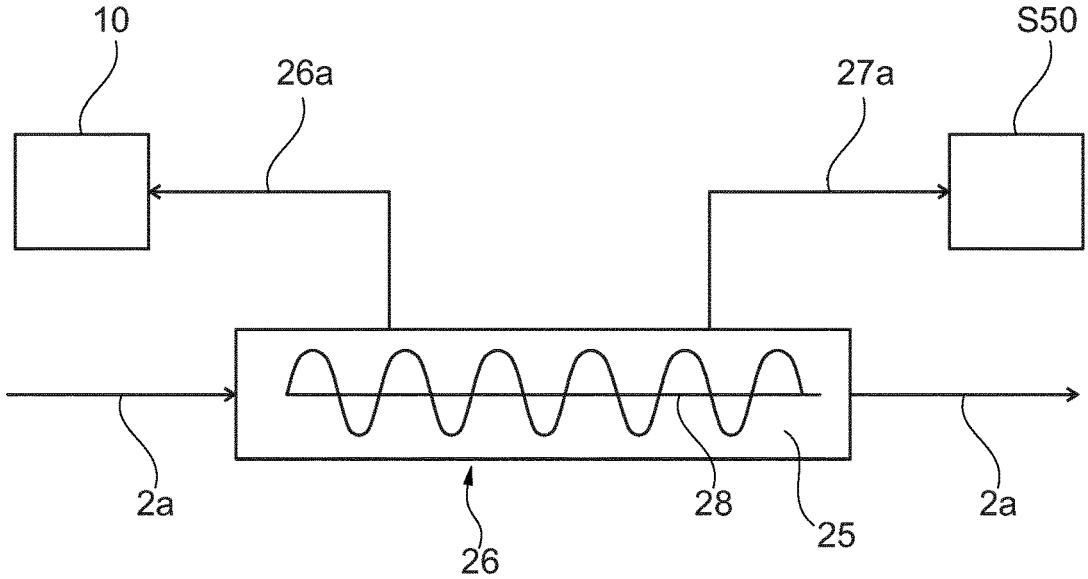
FIG. 2B shows a separation unit according to another embodiment of the invention.

FIG. 2B shows an embodiment of the separation unit 25 with only one stage, in particular with a compression stage 26. It is possible that, in the compression stage 26, a part of impregnation liquid 27*a* is drained from the impregnated biomass 2*a* and that another part of the impregnation liquid 26*a* is released from the impregnated biomass 2*a* by the compression. The compression stage 26 may thus result in a first part of impregnation liquid 26*a* released from the impregnated biomass 2*a* by compression and a second part of impregnation liquid 27*a* drained from the impregnated biomass 2*a* wherein the first part of impregnation liquid 26*a* and the second part of impregnation liquid 27*a* are fed or transferred to different target locations.

The separation unit 25 may also be referred to as a dewatering or washing stage. The separation unit 25 comprises a drainage stage integrated into the compression stage 26. The drainage stage may comprise a drain screw for conveying the impregnated biomass 2*a* during the drainage in which free water is released from the impregnated biomass 2*a*. The compression stage 26 may comprise one of a screw press, a plug screw, twin rolls or simply a press such that the first part of the impregnation liquid 26*a* can be released from the impregnated biomass 2*a*.

In case the separation unit 25 comprises a one-stage configuration, e. g. the separation unit 25 only comprises the compression stage 26, then the compression stage 26 may comprise one of a screw press, a plug screw, twin rolls or simply a press. Furthermore, several areas within the compression unit 26 may be provided in which different parts of the liquid are released from the impregnated biomass 2*a*. In this manner, it is possible that the first part of impregnation liquid 26*a* is released separately from the second part of impregnation liquid 27*a*.

Figure 3:
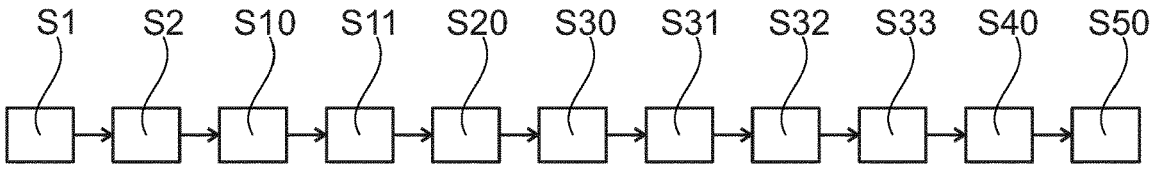
FIG. 3 shows a flow diagram for a method for treating biomass according to an embodiment of the invention.

FIG. 3 shows a flow diagram for a method for treating biomass 2. In step S1 of the method, a pre-compression of the biomass 2 in a pre-compression unit 6 is carried out before compressing the biomass 2 within a compression unit 5. The pre-compression unit 6 may comprise a force feed screw for pre-compressing the biomass 2. In a step S2 of the method, a compression of the biomass 2 in a compression unit 5 is carried out before feeding the biomass 2 to a first reactor unit 10, wherein the compression unit 5 comprises a plug screw for compressing the biomass 2. In a step S10 of the method, the biomass 2 and an impregnation liquid are fed into the first reactor unit 10 such that the biomass 2 is impregnated with the impregnation liquid while the biomass 2 is transferred through the first reactor unit 10 by a conveyor means 11. In a step S11, impregnated biomass 2*a* is fed from the first reactor unit 10 into a second reactor unit 20 before transferring the impregnated biomass 2*a* to the separation unit 25, wherein a hydrolysis of the impregnated biomass 2*a* takes place within the second reactor unit 20. In a step 20 of the method, the impregnated biomass 2*a* is transferred from the first reactor unit 10 to the separation unit 25 wherein at least a part of the impregnation liquid 26*a*, 27*a* is separated from the impregnated biomass 2*a* within the separation unit 25. In a further step S30 of the method, the separated impregnation liquid 26*a*, 27*a* is discharged from the separation unit 25 such that only a part of the impregnation liquid 26*a* is recirculated back to the first reactor unit 10. In another step S31, a fractionation or a filtration of the separated impregnation liquid 26*a*, 27*a* is carried out in a fractionation unit 29 or filtration unit 29 such that a predetermined purity degree of the recirculated impregnation liquid 26*a* can be adjusted. In another step S32, a mixing of the recirculated impregnation liquid 26*a* from the separation unit 25 with fresh impregnation liquid 12*b* from the reservoir 40 is carried out before injecting the mixed impregnation liquid into the first reactor unit 10. In another step S33, an injection of the recirculated impregnation liquid 26*a* from the separation unit 25 into the first reactor unit 10 is carried out such that the recirculated impregnation liquid 26*a* is reused for impregnating the fed biomass 2 within the first reactor unit 10. In another step S40, the impregnated biomass 2*a* is transferred from the separation unit 25 to a third reactor unit 30 wherein a steam explosion on the impregnated biomass 2*a* takes place within the third reactor unit 30. In yet another step S50 of the method, a second part of the impregnation liquid 27*a* separated in the separation unit 25, e. g. the part of the separated impregnation liquid which is not recirculated back to the first reactor unit 10 is transferred to a treatment step downstream the separation unit 25.

While the invention has been illustrated and described in detail in the drawings and the foregoing description, such illustration and description are to be considered illustrative and exemplary and not restrictive; the invention is not limited to the disclosed embodiments. Other variations to the disclosed embodiments can be understood and effected by those skilled in the art and practicing the claimed invention, from a study of the drawings, the disclosure, and the appended claim. In the claims the term "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of protection.

The invention claimed is:

1. A method for treating biomass, the method comprising:

feeding biomass (2) and an impregnation liquid into a first reactor unit (10) such that the biomass (2) is impregnated with the impregnation liquid while the biomass (2) is transferred through the first reactor unit (10) by a conveyor means (11, S10);

wherein the first reactor unit (10) is filled with impregnation liquid up to a predetermined fill level (13), the biomass (2) is transferred in an upward direction within the first reactor unit (10) and the entire biomass (2) is transferred through the impregnation liquid;

transferring the impregnated biomass (2*a*) from the first reactor unit (10) to a separation unit (25), wherein at least a part of the impregnation liquid is separated from the impregnated biomass (2*a*) within the separation unit (25, S20);

discharging the separated impregnation liquid from the separation unit (25), such that a first part (26*a*) of the separated impregnation liquid is recirculated back to the first reactor unit (10, S30); and injecting the recirculated first part of impregnation liquid (26*a*) from the separation unit (25) into the first reactor unit (10) such that the recirculated first part of impregnation liquid (26*a*) is used for impregnating the fed biomass (2) within the first reactor unit (10, S33).

2. The method of claim 1, wherein the separation of the impregnation liquid within the separation unit (25) comprises a compression stage (26) in which the impregnation liquid is released from the impregnated biomass (2*a*) by compressing the impregnated biomass (2*a*).

3. The method of claim 2, wherein a second part (27*a*) of the impregnation liquid released from the impregnated biomass (2a) in the compression stage (26) is transferred to a treatment step (S50) downstream the separation unit (25).

4. The method of claim 1, wherein the separation of the impregnation liquid within the separation unit (25) comprises a drainage stage (27) in which free impregnation liquid (27*a*) is drained from the impregnated biomass (2*a*) without compression.

5. The method of claim 4, wherein the free impregnation liquid (27*a*) drained from the impregnated biomass (2*a*) in the drainage stage (27) is transferred to a treatment step (S50) downstream the separation unit (25).

6. The method of claim 1 further comprising fractionating the separated first part of impregnation liquid (26*a*) in a fractionation unit (29) until a predetermined purity degree of the recirculated impregnation liquid is reached (S31).

7. The method of claim 1 further comprising mixing the recirculated first part of impregnation liquid (26*a*) from the separation unit (25) with impregnation liquid (12*b*) from a reservoir (40) before injecting the mixed impregnation liquid to the first reactor unit (10, S32).

8. The method of claim 1 further comprising feeding the impregnated biomass (2*a*) from the first reactor (10) unit into a second reactor unit (20) before transferring the impregnated biomass (2*a*) to the separation unit (25), wherein a hydrolysis of the impregnated biomass (2*a*) takes place within the second reactor unit (20, S11).

9. The method of claim 1 further comprising transferring the impregnated biomass (2*a*) from the separation unit (25) to a third reactor unit (30), wherein a steam impact of the impregnated biomass (2*a*) takes place within the third reactor unit (30, S40).

10. The method of claim 1, wherein the impregnation liquid is fed into the first reactor unit (10) up to a predetermined fill level (13) such that at least a part of the biomass (2) which is fed into the first reactor unit (10) is in permanent contact with the impregnation liquid.

11. The method of claim 1, wherein the conveyor means (11) of the first reactor unit (10) is a screw conveyor arranged with a vertical component, such that the biomass (2) is conveyed in an upward direction (3) during the impregnation.

12. The method of claim 1 further comprising compressing the biomass (2) in a compression unit (5) before feeding the biomass (2) into the first reactor unit (10), wherein the compression unit (5) comprises a plug screw for compressing the biomass (2, S2).

13. The method of claim 1 further comprising pre-compressing the biomass (2) in a pre-compression unit (6) before compressing the biomass (2) within the compression unit (5), wherein the pre-compression unit (6) in particular comprises a force feed screw for pre-compressing the biomass (2, S1).

14. The method of claim 2, wherein the compressing the impregnated biomass (2*a*) is conducted with a screw press (28).

15. The method of claim 4, wherein the free impregnation liquid (27*a*) is drained from the impregnated biomass (2*a*) without compression and by gravity draining.

16. The method of claim 9, wherein the steam impact is a steam explosion.

17. The method of claim 11, wherein the vertical component is vertically within the first reactor unit (10).

18. The method of claim 1, wherein the conveyor means (11, S10) is a mechanical conveyor means.

19. The method of claim 1, wherein the conveyor means (11, S10) is a screw conveyor.

20. The method of claim 1, wherein the first reactor unit is a longitudinal vessel arranged vertically with respect to an earth's surface.

* * * * *